US005234120A

United States Patent [19]

Bandera

[11] Patent Number: 5,234,120

[45] Date of Patent: Aug. 10, 1993

[54] SECTIONAL BOX WITH CORNER FORMING AND LOCKING ELEMENTS

[75] Inventor: Luigi Bandera, Busto Arsizio, Italy

[73] Assignee: Costruzioni Meccaniche Luigi Bandera S.p.A., Busto Arsizio, Italy

[21] Appl. No.: 909,710

[22] Filed: Jul. 7, 1992

[30] Foreign Application Priority Data

Jul. 9, 1991 [IT] Italy ..... MI.91-U/000632

[51] Int. Cl.[5] ..... B65D 57/00

[52] U.S. Cl. ..... 220/4.28; 229/198.1

[58] Field of Search ..... 220/4.28, 6, 7, 62; 229/198.1

[56] References Cited

U.S. PATENT DOCUMENTS 3,226,008 12/1965 Chiorri ..... 229/198.1
3,544,021 12/1970 Wilson et al. ..... 220/7
3,857,540 12/1974 Ecker ..... 220/4.28 X
4,005,795 2/1977 Mikkelsen et al. ..... 220/62 X
4,078,716 3/1978 Harley et al. ..... 229/198.1
4,210,274 7/1980 Leonard ..... 229/198.1

*Primary Examiner*—Steven M. Pollard
*Attorney, Agent, or Firm*—Cushman, Darby & Cushman

[57] ABSTRACT

A sectional box with corner forming and locking elements comprising a thermoformed plastics sheet element having a central panel element of quadrilateral shape the sides of which are connected via preferential bending lines to four sides of lateral panel elements which can be bent over box-like on the central panel, in which on those sides extending from the corners of the central panel element, the lateral panel elements are provided with flanges which project outwards from the lateral panel elements and are in total mutually facing contact when the box is in its formed state.

3 Claims, 3 Drawing Sheets

10
11
12
13
14
15
16
17
18
25
26
27

SECTIONAL BOX WITH CORNER FORMING AND LOCKING ELEMENTS

BACKGROUND OF THE INVENTION

This invention relates to a sectional box with corner forming and locking elements.

In the packing and packaging of fruit and vegetables, the container means used are in the form of wooden or plastics boxes of various types and shapes, which, although being sufficiently strong and of low cost, present problems in terms of their transport when empty and their possible recovery.

If they are collected in one region for transportation to or use in a region distant from the first, these problems are more deeply felt and aggravate utilization costs and times.

To obviate these drawbacks, sectional thermoformed plastics sheet boxes have been proposed which can be assembled and then locked in their assembled state by pin elements insertable through suitable holes in parts of the box as thermoformed.

This system is, however, rather complicated to use and suffers from alignment and insertion problems during assembly.

SUMMARY OF THE INVENTION

An object of the present invention is to solve the aforesaid problems by means of a sectional box also obtained by plastics thermoforming but being very simple to construct and assemble. A further object is to provide a box of the aforesaid type which is of low cost and is easily transportable within an extremely small space.

These objects are attained according to the present invention by a sectional box with corner forming and locking elements comprising a thermoformed plastics sheet element having a central panel element of quadrilateral shape the sides of which are connected via preferential bending lines to four sides of lateral panel elements which can be bent over box-like on the central panel, characterised in that on those sides extending from the corners of the central panel element, the lateral panel elements are provided with flanges which project outwards from the lateral panel elements and are in total mutually facing contact when the box is in its formed state.

BRIEF DESCRIPTION OF THE DRAWINGS

The structural and functional characteristics and advantages of a sectional box according to the present invention will be more apparent from the description of one embodiment thereof given hereinafter by way of non-limiting example with reference to the accompanying drawings, in which.

DETAILED DESCRIPTION

Figure 1:
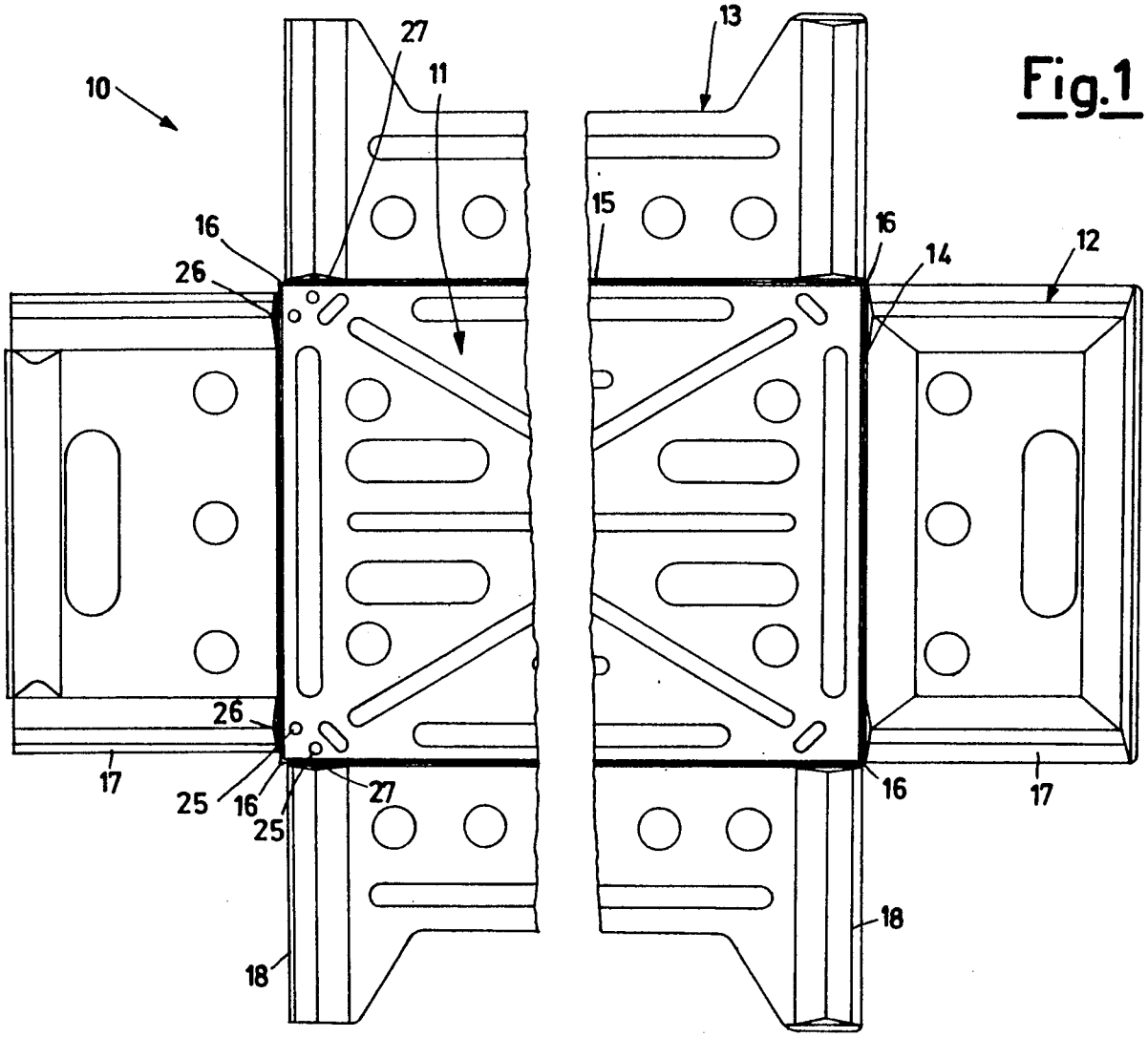
FIG. 1 is a top plan view of a sectional box according to the invention in plane development.

The drawing figures show a thermoformed plastics sheet element indicated overall by 10 and consisting essentially of several variously shaped panel parts articulatedly joined together.

The thermoformed element constitutes the plan development of the sectional box and comprises a central panel element 11 of quadrilateral shape, this being rectangular in the example, and four lateral panel elements 12 and 13 arranged in equal and opposite pairs. These panel elements comprise, for example, ribs, material cut-outs and various holes which stiffen them individually in addition to lightening them. In addition, the lightening cut-outs allow an immediate recovery of part of the material, which is returned to the production cycle and used to form further boxes, with maximum and optimum utilization of the entire material.

The central panel element 11 and the lateral panel elements 12 and 13 are connected together via preferential bending lines 14 and 15, respectively, these also being formed during the thermoforming.

The four lateral panels elements 12 and 13 can be bent over to form a box with the central panel 11, and are provided, on those sides extending from the corners 16 of the central panel element 11, with flanges 17 and 18 which project outwards from the lateral panel elements. When the lateral panel elements 12 and 13 have been bent over relative to the central panel 11 so that they lie side by side to form the box, these flanges assume a vertical position relative to the horizontal central panel and can be brought together so that parallel portions are in mutual contact.

When the flanges 17 and 18 have been brought into mutual contact as stated, they are inserted into a gripping and locking element consisting of a column 19 with a central vertical slot 20 defined by two shaped vertical walls 21.

The shaped walls 21 extend from a region in proximity to the corner of the column 19, which has a cross-section in the form of a right isosceles triangle. The two walls 21 are maintained in position by a plurality of horizontal ribs 22 extending from surrounding walls 23 defined by the equal sides of the isosceles triangle.

At its lower end, this column comprises a pair of vertical pin elements 24, which ar to be inserted into corresponding holes 25 provided almost in proximity to the corners of the central panel 11, and into further holes 26 provided in turned-over portions 27 also associated with the central panel 11 in correspondence with its corners. The pin elements 24 and the holes 25 and 26 hence act as a centering system and also partly cooperate in locking the parts together.

A sectional box according to the present invention can be assembled very rapidly from its flat transport and storage position by simply inserting the flanges 17 and 18 into the slot 20 in four column elements 19. The particular shape of the slot 20 and the provision of stiffening ribs 22 on the column 19 result in optimum locking of the flanges 17 and 18 which are inserted into them and compressed together.

When it has been used for containing and transporting products, the box can be again broken down into the flat part and its corner locking elements, allowing considerable ease of transport. In this respect, the advantage of stackability to minimum bulk within small spaces is achieved.

Figure 6:
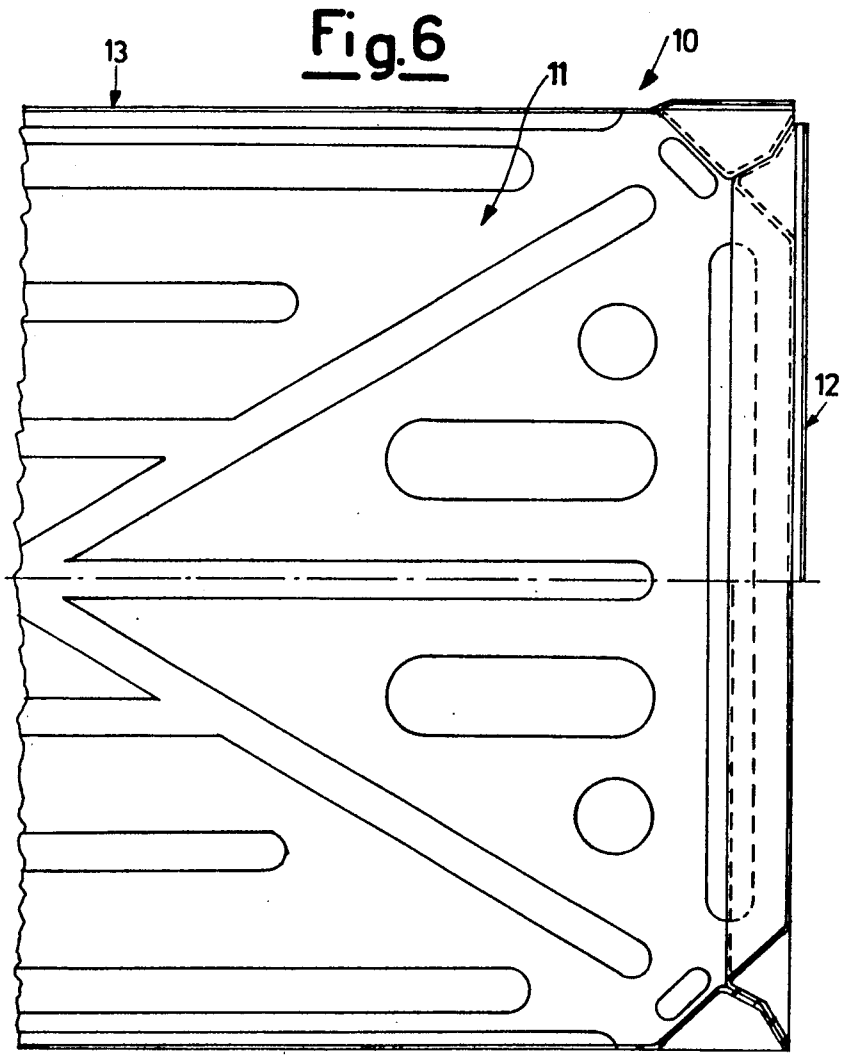
FIG. 6 is a partly sectional plan view of one half of an assembled box of FIG. 1, welded at its corners.
Figure 2:
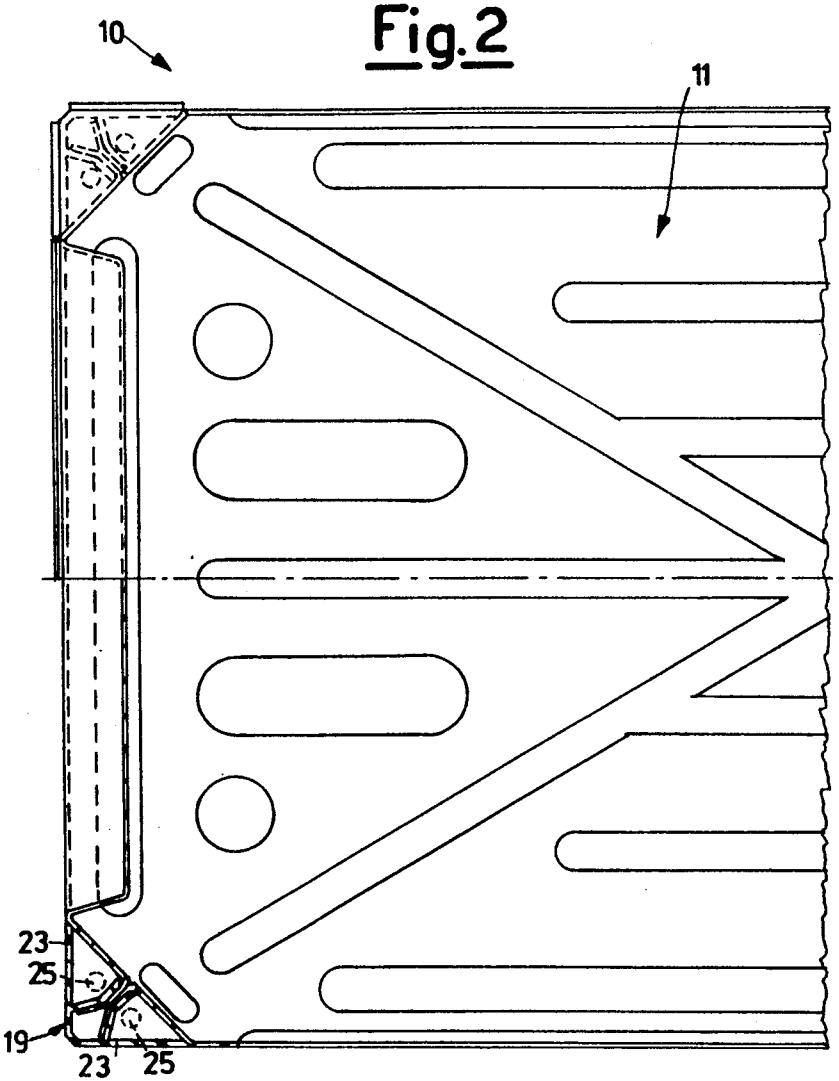
FIG. 2 is a partly sectional top plan view of one half of an assembled box of FIG. 1.
Figure 3:
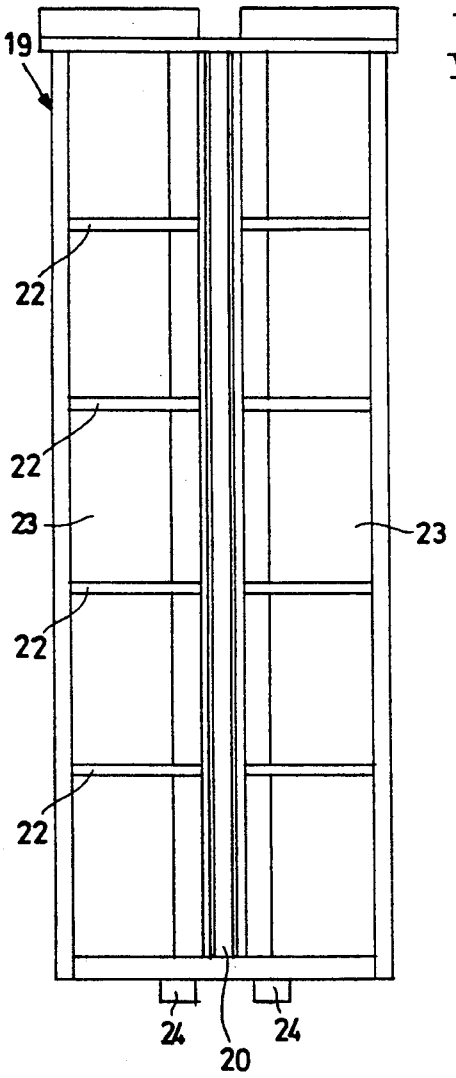
FIG. 3 is an elevational view of a connection element for the flanges projecting from the corners of the box of FIG. 1.
Figure 4:
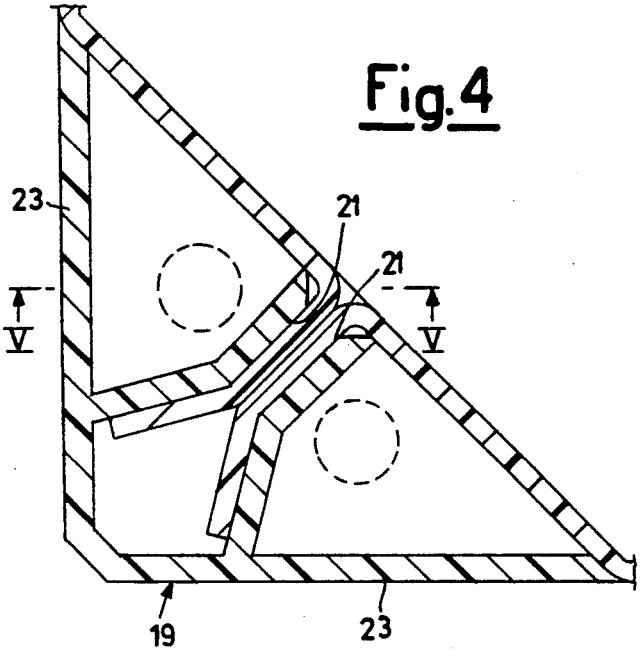
FIG. 4 is an enlarged detailed view of a corner of FIG. 2.
Figure 5:
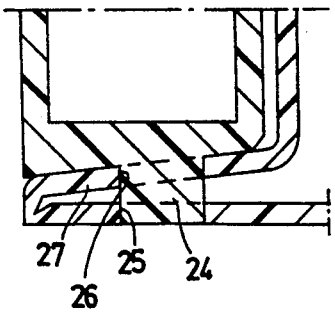
FIG. 5 is a section on the line V—V of FIG. 4 of the connection element, which is only partly shown.

Alternatively and advantageously, if the box is not to be reused, instead of using the corner locking columns the corner flanges can be joined together when in mutual contact. FIG. 6 shows how two contacting flanges can be welded together, for example using ultrasound, to form the box according to the invention.

I claim:

1. A sectional box with corner forming and locking elements, comprising:

a thermoformed plastics sheet element having a central panel element of quadrilateral shape the sides of which are connected via preferential bending lines to four sides of lateral panel elements which can be bent over box-like on said central panel;

on respective sides thereof extending from the corners of said central panel element, said lateral panel elements being provided with flanges which project outwards from said lateral panel elements and are in total mutually facing contact when the box is in its formed state;

a gripping and locking element being associated with said flanges;

said gripping and locking element comprising a column having a central vertical slot defined by two shaped vertical walls;

said two shaped vertical walls each extending from a respective region in proximity to a respective corner of said column, which has a cross-section in the form of a right isosceles triangle having two equal sides;

said two shaped vertical walls being maintained in position by a plurality of horizontal ribs extending from surrounding walls defined by said equal sides of said isosceles triangle cross-section.

2. A sectional box as claimed in claim 1, wherein:

at a lower end thereof said column also comprises a pair of vertical pin elements arranged to be inserted into corresponding holes provided almost in proximity to said corners of said central panel, and into further holes provided in turned-over portions also associated with said central panel in correspondence with said corners.

3. A sectional box as claimed in claim 1, wherein:

said flanges are welded together and in mutual contact.

* * * * *